US009790760B2

(12) United States Patent
Nguyen

(10) Patent No.: US 9,790,760 B2
(45) Date of Patent: Oct. 17, 2017

(54) RADIALLY ENERGIZED HANGER SYSTEM

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 261 days.

(21) Appl. No.: 14/587,895

(22) Filed: Dec. 31, 2014

(65) Prior Publication Data

US 2016/0186521 A1 Jun. 30, 2016

(51) Int. Cl.
*E21B 33/04* (2006.01)

(52) U.S. Cl.
CPC ..... *E21B 33/04* (2013.01); *E21B 33/0422* (2013.01)

(58) Field of Classification Search
None
See application file for complete search history.

(56) References Cited

U.S. PATENT DOCUMENTS 1,825,774 A * 10/1931 Boynton ..... E21B 33/04 166/88.1
2,683,045 A * 7/1954 Brooks ..... E21B 33/0422 211/70.4
2,850,301 A 9/1958 Herbert
3,134,610 A * 5/1964 Musolf ..... E21B 33/0422 166/88.3
3,287,035 A * 11/1966 Greenwood ..... E21B 33/0422 285/123.8
4,306,742 A * 12/1981 Hardcastle ..... F16L 3/00 188/67
4,714,111 A * 12/1987 Brammer ..... E21B 33/04 166/182
5,031,696 A * 7/1991 Zwiegel ..... E21B 33/0422 166/207
5,524,710 A * 6/1996 Shinn ..... E21B 19/006 166/348
6,488,084 B1 * 12/2002 Borak, Jr. ..... E21B 33/0422 166/208

FOREIGN PATENT DOCUMENTS

GB 955246 A 4/1964
WO 2013/158031 A1 10/2013

OTHER PUBLICATIONS

PCT International Search Report and Written Opinion; Application No. PCT/US2015/065613; Dated Mar. 9, 2016; 11 pages.

* cited by examiner

*Primary Examiner* — Shane Bomar
(74) *Attorney, Agent, or Firm* — Fletcher Yoder, P.C.

(57) ABSTRACT

A system including a hanger system configured to support a tubular, including a hanger body with first and second axial sides, and an aperture extending between the first and second axial sides, wherein the hanger body is configured to receive the tubular through the aperture, a first retaining ring configured to couple to the tubular, and a first support ring configured to couple to the first axial side of the hanger body and radially energize the first retaining ring.

25 Claims, 5 Drawing Sheets

RADIALLY ENERGIZED HANGER SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In some drilling and production systems, hangers, such as a tubing hanger, may be used to suspend strings of tubing for various flows in and out of a well. Such hangers may be disposed within a wellhead that supports both the hanger and the string. For example, a tubing hanger may be lowered into a wellhead and supported therein.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a hanger system capable of coupling to and sealing with tubing in one movement. In some embodiments, the hanger system may include a support ring that couples to a hanger body. In operation, as the support ring moves axially, the support ring radially energizes a seal that seals with the tubing as well as energizes a retainer ring that couples to and suspends tubing within a spool. In certain embodiments, the hanger system may include a bearing between the seal and the retainer ring.

The bearing may enable the seal and retainer ring to move independently of each other, facilitating retention and sealing with the tubing. In certain embodiments, the hanger system may include an additional seal and/or retaining ring on an axially opposite side of the hanger body that provides additional/redundant sealing with and/or retention of the tubing.

Figure 1:
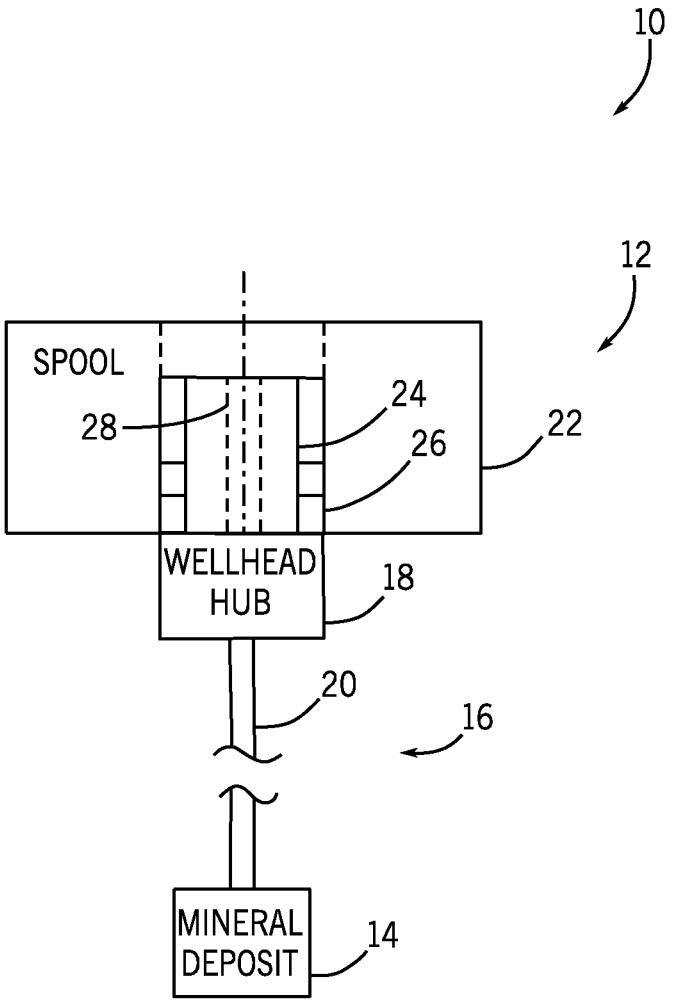
FIG. 1 is a block diagram of an embodiment of a mineral extraction system with a hanger system.

FIG. 1 is a block diagram that illustrates a mineral extraction system 10 (e.g., hydrocarbon extraction system) that can extract various minerals and natural resources, including hydrocarbons (e.g., oil and/or natural gas) from the earth. The system 10 includes a wellhead 12 coupled to a mineral deposit 14 via a well 16, wherein the well 16 includes a wellhead hub 18 and a well-bore 20. The wellhead hub 18 includes a large diameter hub at the end of the well-bore 20 that enables the wellhead 12 to couple to the well 16. The wellhead 12 includes multiple components that control and regulate activities and conditions associated with the well 16. For example, the wellhead 12 includes a spool 22 (e.g., tubular) and a hanger system 24.

The wellhead 12 enables completion and workover procedures, such as tool insertion (e.g., the hanger system 24). Further, minerals extracted from the well 16 (e.g., oil and natural gas) may be regulated and routed via the wellhead 12. For example, a blowout preventer (BOP) "Christmas" tree may include a variety of valves, fittings, and controls to prevent oil, gas, or other fluid from exiting the well.

As illustrated, the spool 22 defines a bore 26 that enables fluid communication between the wellhead 12 and the well 16, and it is within the bore 26 that the hanger system 24 suspends tubing 28 (e.g., production tubing). Thus, the casing spool bore 26 may provide access to the well bore 20 for various completion and workover procedures. As will be explained in detail below, the hanger system 24 couples to the tubing 28 while simultaneously forming a seal with the tubing 28 to control the flow of fluid out of the well 20.

Figure 2:
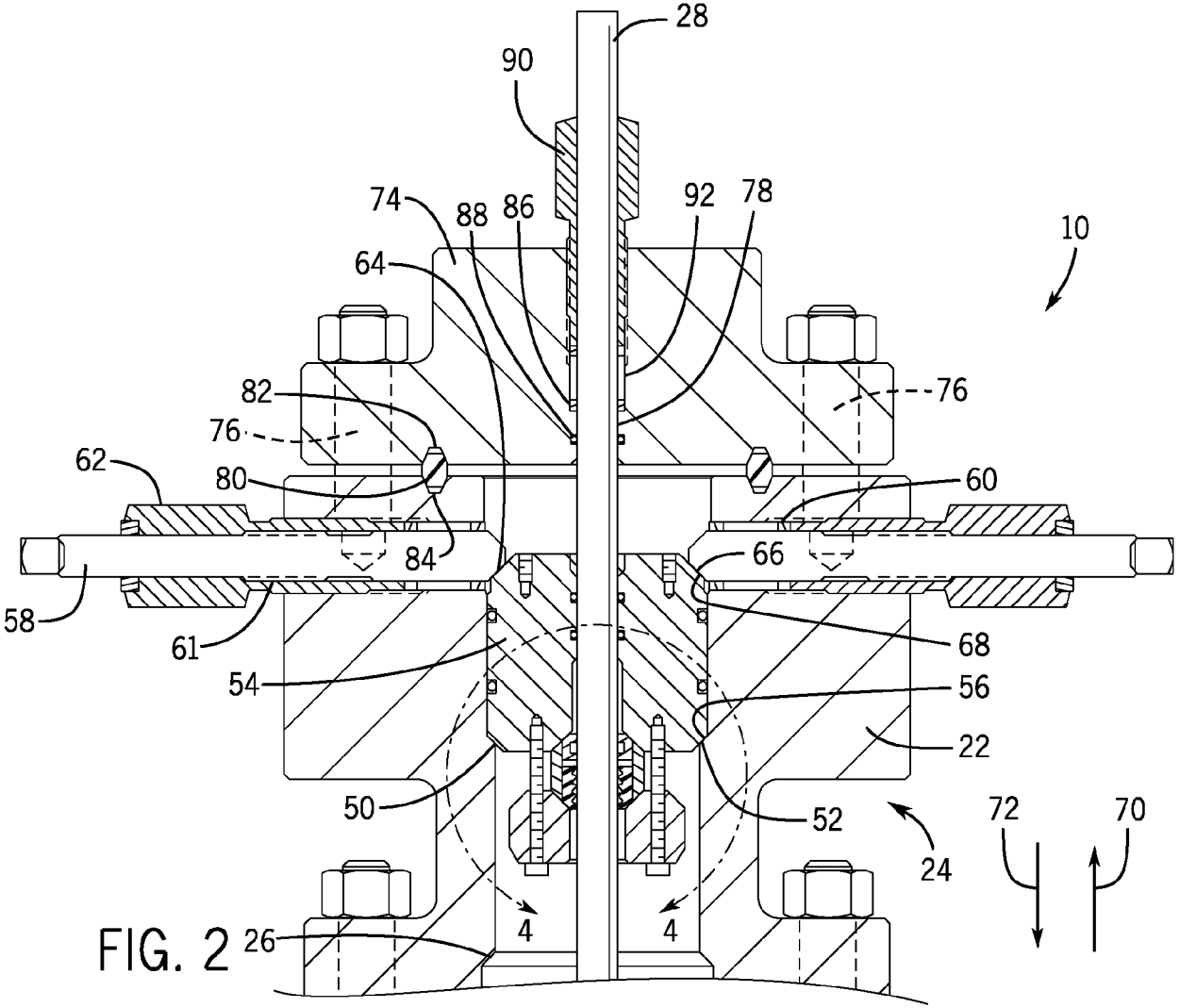
FIG. 2 is a cross-sectional view of an embodiment of a hanger system.

FIG. 2 is a cross-sectional view of an embodiment of a mineral extraction system 10 with a hanger system 24. As illustrated, the hanger system 24 rests on a ledge 50 (e.g., annular ledge or shoulder) in the bore 26 of the spool 22. The ledge 50 supports the hanger system 24 enabling the hanger system 24 to suspend the tubing 28 in the well 20. In some embodiments, the ledge 50 may be an angled surface (e.g., tapered annular surface) that engages an angled surface 52 (e.g., tapered annular surface) on a tubing hanger body 54. Together the ledge 50 and angled surface 52 form an angled interface 56 (e.g., tapered annular interface or frusto-conical interface) that supports the tubing hanger system 24 in the spool 22. The mineral extraction system 10 may then secure the hanger system 24 within the spool 24, with one or more radial lock members such as lock screws 58 (e.g., 1, 2, 3, 4, 5, etc.). For example, the lock screws 58 may extend through and threadingly couple to one or more radial apertures 60 (e.g., 1, 2, 3, 4, 5, etc.) and into the bore 26. Thus, after placement of the tubing hanger system 24 in the spool 22, the lock screws 58 may be threaded into the lock screw carriers 60 (e.g., apertures 61 in the lock screw carriers 60) or glands until the lock screws 58 extend into the bore 26 and contact the tubing hanger body 54. In some embodiments, the lock screws 58 may form an angled interface 64 (e.g., tapered annular interface or frusto-conical interface) with the tubing hanger body 54. For example, the lock screws 58 may include an angled surface 66 (e.g., tapered tip portion) that contacts an angled surface 68 (e.g., annular) on the hanger body 54. In operation, the angled interface 64 blocks axial movement of the hanger system 24 in direction 70 while simultaneously providing a downward force in axial direction 72. In other words, the angled interface 66 axially compresses the hanger body 54 between the ledge 50 and the lock screws 58 as the angled surfaces 66 and 68 contact each other.

After securing the hanger system 24, a seal flange 74 may be coupled to the spool 22 with fasteners, such as threaded fasteners 76 (e.g., bolts). The seal flange 74 includes an aperture 78 that enables the tubing hanger 28 to communicate with external equipment as well as sealing of the spool 22. For example, the sealing flange 74 may include a seal 80 (e.g., annular seal) that rests within a groove 82 (e.g., annular groove) in the seal flange 74 and/or within a groove 84 (e.g., annular groove) in the spool 22. The seal flange 74 may also include seals 86 and 88 that form a seal around the tubing 28. In some embodiments, a threaded retainer 90 (e.g., threaded sleeve or seal energizing sleeve) may hold seals 92 within a counterbore 90.

Figure 3:
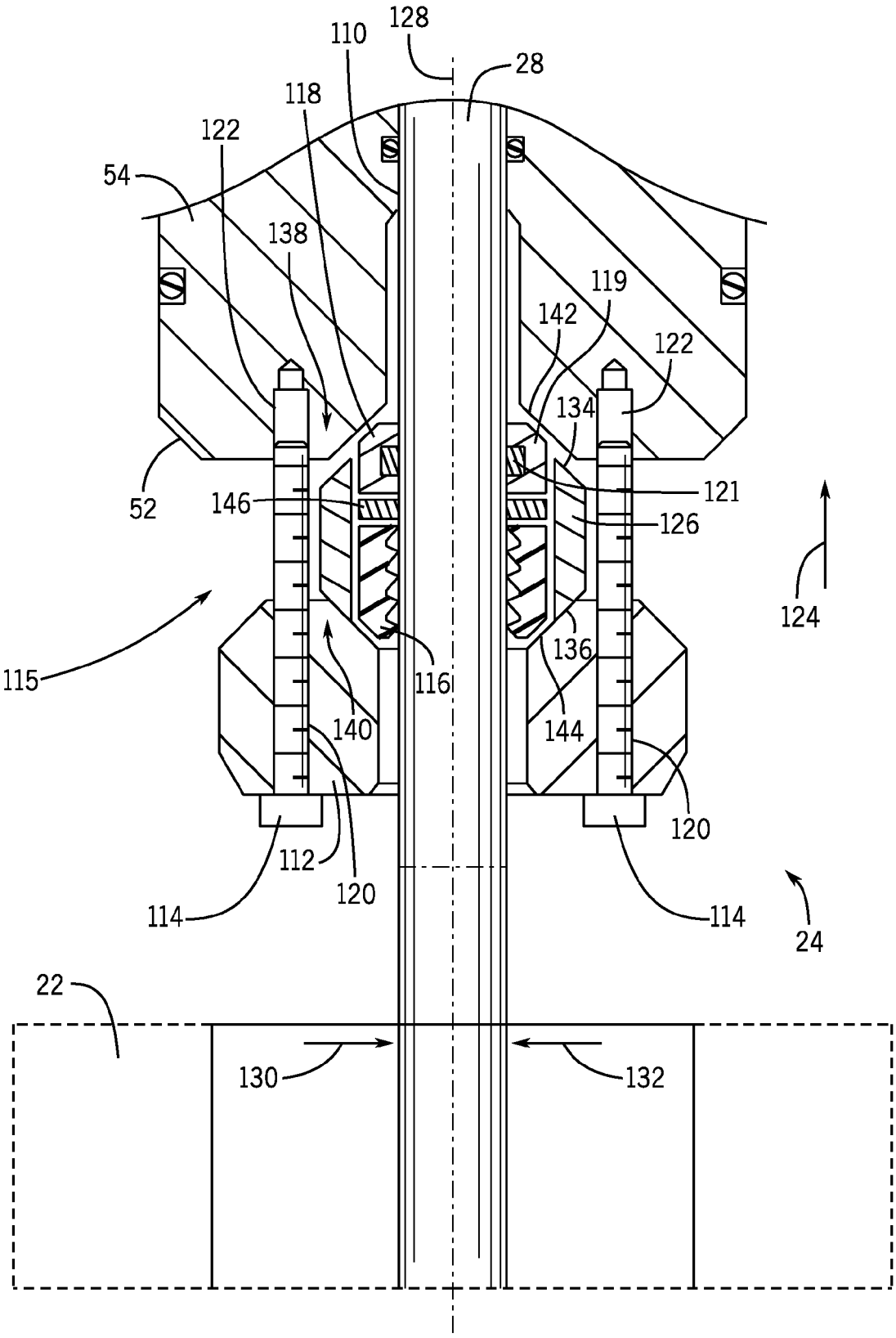
FIG. 3 is a partial sectional view of an embodiment of an unenergized hanger system.

FIG. 3 is a partial sectional view of an embodiment of an unenergized hanger system 24. As illustrated, the hanger system 24 includes an aperture 110 that enables the tubing 28 to pass through the hanger body 54. In order to couple to and seal with the tubing 28, the tubing system 24 includes a support ring 112. The support ring 112 couples to the hanger body 54 with one or more threaded fasteners such as bolts 114 (e.g., 1, 2, 3, 4, 5, etc.), on a first axial side 115 of the hanger body 54. The bolts 114 enable the support ring 112 to compress a retaining ring 116 (e.g., c-ring, slip ring) and seal 118 (e.g., metal seal, elastomeric seal, or a combination thereof) against the tubing 28, which couples and seals the tubing 28 to the hanger system 24. For example, the seal 118 may include a metal seal portion 119 that surrounds an elastomeric seal 121.

As illustrated, the bolts 114 pass through apertures 120 in the support ring 112 and threadingly couple to apertures 122 in the hanger body 54. In operation, the bolts 114 drive the support ring 112 in axial direction 124 and into contact with the retaining ring 116 and an energizing ring 126 (e.g., c-ring, slip ring). In some embodiments, the energizing ring 126 (e.g., segmented ring) may include a plurality of segments that extend about the axis 128 (e.g., 2, 3, 4, 5, or more). In certain embodiments, the seal 118 (e.g., segmented seal) may also include a plurality of segments (e.g., 2, 3, 4, 5, or more) that extend about the tubing 28. In operation, the energizing ring 126 circumferentially energizes the retaining ring 116 and seal 118 in radial directions 130 and 132 using axial force from the support ring 112. As illustrated, the energizing ring 126 includes first and second angled surfaces 134, 136. These surfaces form angled interfaces 138 and 140 (e.g., annular angled interfaces) with respective angled surfaces 142, 144 on the hanger body 142 and support ring 112. Accordingly, as the bolts 114 drive the support ring 112 in axial direction 124, the angled interfaces 138 and 140 drive the energizing ring radially inward in directions 130 and 132 radially compressing the retaining ring 116 and seal 118 against the tubing 128. In some embodiments, the hanger system 24 may include a bearing 146 (e.g., ring) axially between the retaining ring 116 and the metal seal 118. In operation, the bearing 146 enables the retaining ring 116 and metal seal 118 to move radially inward in directions 130 and 132 independent of each other. The ability to move independently may improve sealing with the seal 118 and retention with the retaining ring 116. For example, the bearing 146 may be an annular or segmented ring with a low friction surface and/or have ball bearings etc. that facilitate movement of the retaining ring 116 and metal seal 118.

Figure 4:
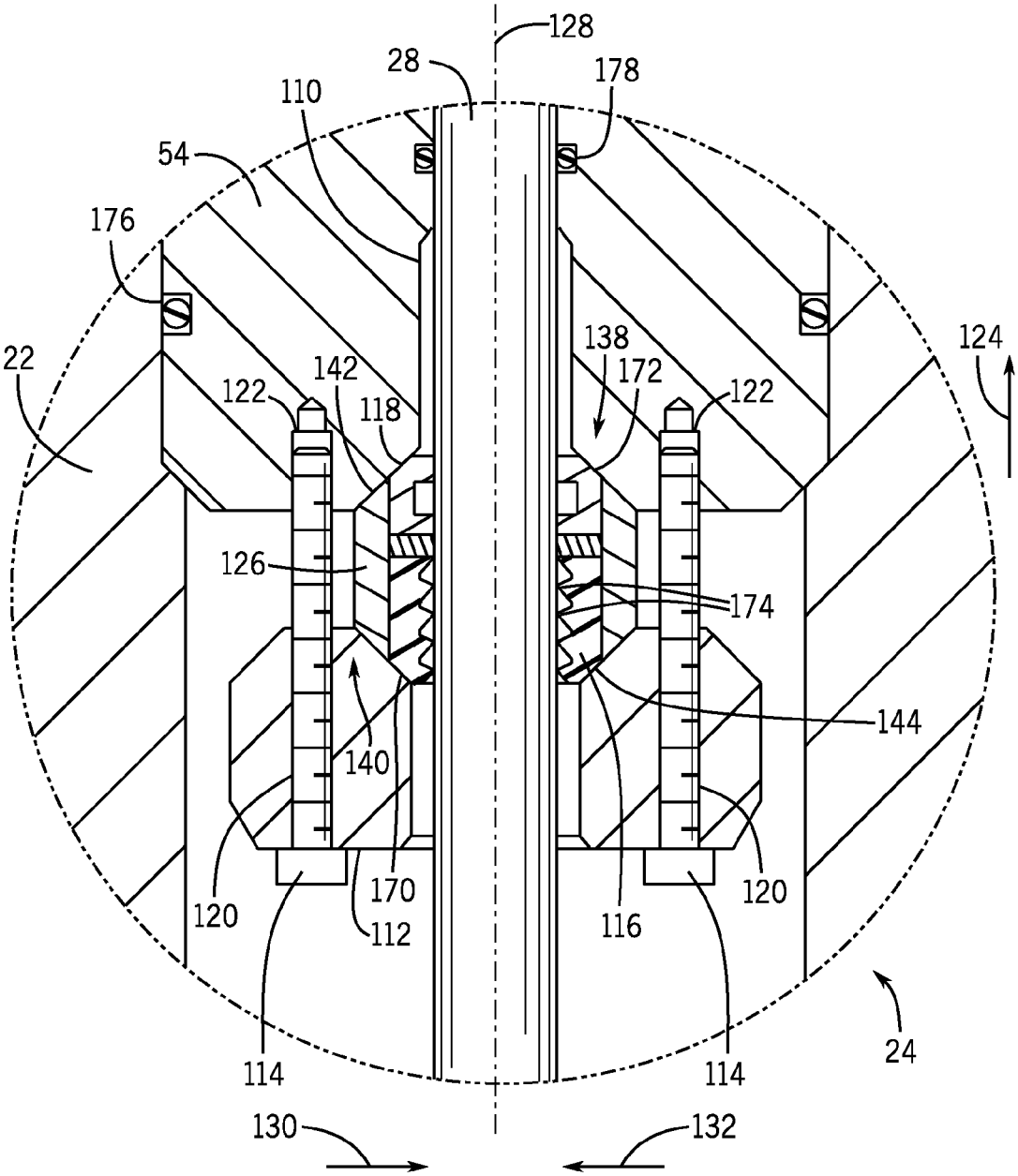
FIG. 4 is a partial sectional view of an embodiment of an energized hanger system within line 3-3 of FIG. 2.

FIG. 4 is a partial sectional view of an embodiment of an energized hanger system 24 within line 3-3 of FIG. 2. As illustrated, the bolts 114 are threaded into the apertures 122 in the hanger body 54 compressing the energizing ring 126 between the support ring 112 and the hanger body 54. As explained above, the support ring 112 axially compresses the energizing ring 126 in direction 124 enabling the angled interfaces 138, 140 to drive the energizing ring 126 radially inward in radial directions 130, 132. As the energizing ring 126 moves radially inward in directions 130, 132, the energizing ring 126 radially compresses the seal 118 and retaining ring 116 against the tubing 28. In some embodiments, the retaining ring 116 and seal 118 may include respective angled surfaces 170 and 172. The angled surfaces 170 and 172 interact with respective angled surface 144 on the support ring 112 and angled surface 142 on the hanger body 54. In operation, the interaction between these angled surfaces facilitates radial movement and radial compression of the retaining ring 116 and seal 118. When energized, the hanger system 24 suspends the tubing 28 with the retainer ring 116, and blocks the flow of fluid through the aperture 110 with the seal 118. In some embodiments, the retaining ring 116 may include one or more protrusions 174 (e.g., teeth) that radially focus pressure in directions 130, 132 to couple (e.g., grip) the retaining ring 116 with the tubing 28.

Figure 5:
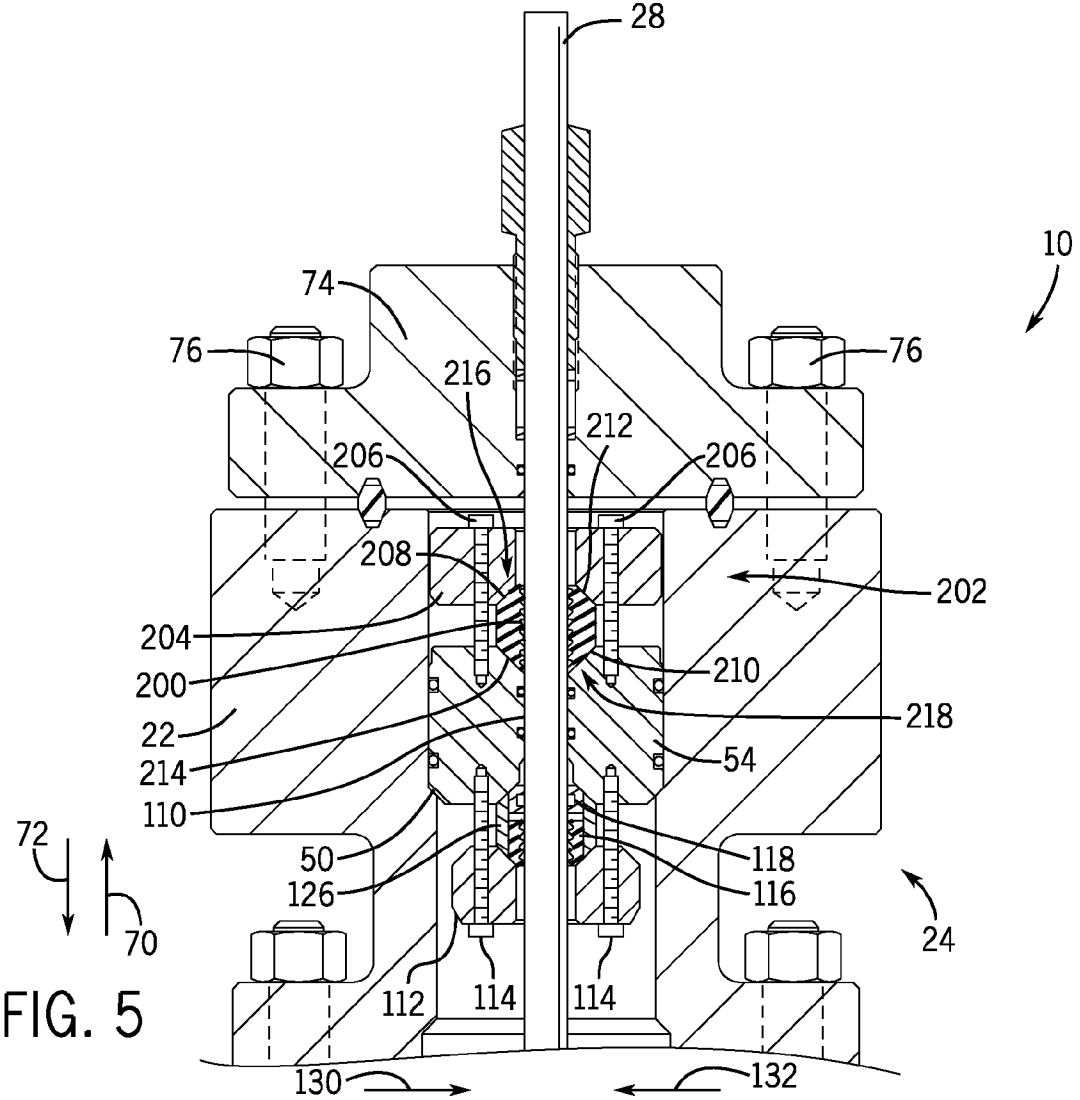
FIG. 5 is a cross-sectional view of an embodiment of a hanger system.

FIG. 5 is a cross-sectional view of an embodiment of a hanger system 24. As explained above, the hanger system 24 includes the hanger body 54, a support ring 112, and bolts 114. In operation, the bolts 114 drive the support ring 112 in axial direction 70 to compress the energizing ring 126. The axial compression drives the energizing ring 126 radially inward compressing the retaining ring 116 and seal 118 against the tubing 28. In this position, the retaining ring 116 suspends the tubing 28 within the spool 22 and the seal 118 blocks fluid flow through the aperture 110. In certain embodiments, the hanger system 26 may provide redundant sealing and/or support by including a second retaining ring 200 and/or a second seal (e.g., seal like 118 placed on a second axial side 202 of the hanger body 54). In operation, the support ring 204 drives the retaining ring 200 radially inward in radial directions 130, 132 as the bolts 206 compresses the support ring 204 in axial direction 72. In certain embodiments, the hanger body 54 and support ring 204 may include respective angled surfaces 208 and 210 (e.g., annular). The angled surfaces 208 and 210 may contact respective angled surfaces 212 and 214 on the retaining ring 200 forming angled interfaces 216 and 218 (e.g., tapered annular interfaces or frusto-conical interfaces). These angled interfaces 216 and 218 may facilitate radial movement of the retaining ring 200 in directions 130 and 132 as the bolts 206 drive the second support ring 204 in axial direction 72. By including the second support ring 204, the mineral extraction system 10 may or may not include the lock screws 58, shown in FIG. 2. Instead, the mineral extraction system 10 may block axial movement of the hanger system 24 using the sealing flange 74 (e.g., bonnet). For example, once the hanger system 24 is placed within the spool 22, the sealing flange 74 is coupled to the casing 22 with the bolts 76. As the bolts 76 compress the sealing flange 74 against the spool 22, the sealing flange 74 may compress the hanger system 24 (e.g., tubing body 54) against the flange 50 blocking/limiting axial movement of the hanger system 24 within the spool 22.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a hanger system configured to mount in a bore of a surrounding tubular and support a tubular, wherein the hanger system comprises:

a hanger body with first and second axial sides, and an aperture extending between the first and second axial sides, wherein the hanger body is configured to receive the tubular through the aperture;

a first retaining ring configured to couple to the tubular; and a first support ring configured to couple to the first axial side of the hanger body, wherein the first support ring is configured to move relative to the hanger body to actuate at least one angled interface to radially energize the first retaining ring about the tubular.

2. The system of claim 1, wherein the hanger system comprises a first seal configured to couple to the tubular, wherein the first retaining ring and the first seal are disposed at least partially axially between the hanger body and the first support ring.

3. The system of claim 2, wherein the hanger system comprises an energizing ring configured to radially energize the first seal and the first retaining ring, wherein the energizing ring is disposed at least partially axially between the hanger body and the first support ring.

4. The system of claim 3, wherein the first support ring is configured to axially compress the energizing ring between the first support ring and the hanger body causing the at least one angled interface to radially compress the first support ring about the first seal and the first retaining ring.

5. The system of claim 3, wherein the at least one angled interface comprises an angled interface between the hanger body and the energizing ring.

6. The system of claim 3, wherein the at least one angled interface comprises an angled interface between the support ring and the energizing ring.

7. The system of claim 3, wherein the at least one angled interface comprises an angled interface disposed on the first retaining ring, the first seal, or a combination thereof.

8. The system of claim 3, wherein the energizing ring is disposed at least partially circumferentially about the first retaining ring and the first seal.

9. The system of claim 2, comprising a bearing axially between the first seal and the first retaining ring, wherein the bearing is configured to enable the first seal and the first retaining ring to move independently in a radial direction relative to a central axis of the hanger system.

10. The system of claim 1, wherein the hanger system comprises a second retaining ring configured to couple to the tubular and a second support ring configured to couple to the second axial side of the hanger body, and the second support ring is configured to radially energize the second retaining ring.

11. The system of claim 1, comprising a mineral extraction system with the hanger system, wherein the mineral extraction system comprises the surrounding tubular configured to receive the hanger system and the tubular in the bore of the surrounding tubular.

12. The system of claim 1, wherein the at least one angled interface comprises one or more angled interfaces disposed between the hanger body and the first support ring.

13. A system, comprising:

a hanger system configured to mount in a bore of a surrounding tubular and support a tubular, wherein the hanger system comprises:

a hanger body with first and second axial sides, and an aperture extending between the first and second axial sides, wherein the hanger body is configured to receive the tubular through the aperture;

a first retaining ring configured to couple to the tubular;

a first seal configured to couple to the tubular; and a first support ring configured to couple to the first axial side of the hanger body, wherein the hanger system is configured to actuate at least one angled interface between the hanger body and the first support ring to radially energize the first retaining ring and the first seal about the tubular.

14. The system of claim 13, wherein the hanger system comprises an energizing ring configured to radially energize the first seal and the first retaining ring about the tubular in response to actuation of the at least one angled interface.

15. The system of claim 14, wherein the hanger system comprises a bearing axially between the first seal and the first retaining ring, wherein the bearing is configured to enable the first seal and the first retaining ring to move independently in a radial direction relative to a central axis of the hanger system.

16. The system of claim 14, wherein the energizing ring is disposed at least partially circumferentially about the first retaining ring and the first seal.

17. The system of claim 13, comprising a mineral extraction system with the hanger system, wherein the mineral extraction system comprises the surrounding tubular configured to receive the hanger system and the tubular in the bore of the surrounding tubular, wherein the surrounding tubular comprises a landing configured to support the hanger body.

18. The system of claim 17, comprising one or more lock screws configured to axially compress the hanger body against the landing.

19. The system of claim 13, wherein the at least one angled interface comprises an angled interface on at least one of the first retaining ring, the first seal, the hanger body, the first support ring, or a combination thereof.

20. The system of claim 19, wherein the hanger system comprises a second retaining ring configured to couple to the tubular and a second support ring configured to couple to the second axial side of the hanger body, and the second support ring is configured to radially energize the second retaining ring.

21. The system of claim 13, wherein the first retaining ring and the first seal are disposed at least partially axially between the hanger body and the first support ring.

22. A method, comprising:

actuating at least one angled interface between a hanger body and a first support ring of a hanger system to provide a radial actuation force; and radially energizing a first seal and a first retaining ring of the hanger system about a tubular in response to the radial actuation force, wherein the hanger system is configured to mount in a bore of a surrounding tubular and support the tubular.

23. The method of claim 22, wherein actuating the at least one angled interface comprises axial movement between the hanger body and the first support ring.

24. The method of claim 22, comprising:

coupling the first support ring of the hanger system to a first portion of the hanger body;

coupling a second support ring of the hanger system to a second portion of the hanger body; and coupling a second retaining ring of the hanger system to the tubular using axial movement of the second support ring.

25. The method of claim 22, wherein actuating the at least one angled interface comprises actuating an angled interface disposed on at least one of the first retaining ring, the first seal, the hanger body, the first support ring, or a combination thereof.

* * * * *